US007290992B2

(12) United States Patent
Palluat de Besset et al.

(10) Patent No.: US 7,290,992 B2
(45) Date of Patent: Nov. 6, 2007

(54) SUSPENSION DEVICE FOR AN ELECTRIC PUMP

(75) Inventors: Olivier Palluat de Besset, Reims (FR); Robert Renaud, Chalons En Champagne (FR)

(73) Assignee: Marwal Systems, Chalons En Champagne (FR)

( * ) Notice: Subject to any disclaimer, the term of this patent is extended or adjusted under 35 U.S.C. 154(b) by 365 days.

(21) Appl. No.: 10/606,569

(22) Filed: Jun. 26, 2003

(65) Prior Publication Data

US 2004/0091372 A1 May 13, 2004

(30) Foreign Application Priority Data

Jun. 28, 2002 (FR) ..... 02 08124

(51) Int. Cl.
*F04B 53/22* (2006.01)

(52) U.S. Cl. ..... 417/360

(58) Field of Classification Search ..... 417/360, 417/363, 423.3, 423.15
See application file for complete search history.

(56) References Cited

U.S. PATENT DOCUMENTS 2,017,302 A * 10/1935 Yoder ..... 417/359
2,926,837 A * 3/1960 Coe ..... 417/363
4,155,529 A * 5/1979 Maudlin ..... 248/604
4,326,476 A * 4/1982 Pole ..... 114/40
4,768,925 A * 9/1988 Geupel ..... 415/213.1
4,964,787 A 10/1990 Hoover
6,126,130 A 10/2000 Planck

FOREIGN PATENT DOCUMENTS

DE 43 36 574 A1 5/1995
EP 0 728 937 A1 8/1996

* cited by examiner

*Primary Examiner*—Anthony Stashick
*Assistant Examiner*—Vikansha Dwivedi
(74) *Attorney, Agent, or Firm*—Blakely Sokoloff Taylor & Zafman

(57) ABSTRACT

The present invention provides a suspension device for an electric pump of an assembly for drawing fuel in a motor vehicle, the device comprising: an outer support suitable for surrounding the electric pump, centered on an axis parallel to the axis of the electric pump, and adapted to be secured to the fuel-drawing assembly; and at least one resilient arm connected to the inside periphery of said outer support, which resilient arm extends essentially in a plane that is transverse to the axis of said outer support and possesses a shape such as to rest at least substantially tangentially against the body of the electric pump over a fraction of its length in order to support it at a distance from the outer support.

13 Claims, 2 Drawing Sheets

SUSPENSION DEVICE FOR AN ELECTRIC PUMP

The present invention relates to the field of devices for drawing fuel from a motor vehicle tank.

The present invention relates more particularly to a suspension device for an electric pump for use in such a fuel-drawing device.

BACKGROUND OF THE INVENTION

The person skilled in the art knows that nowadays most devices for drawing fuel in motor vehicles comprise an assembly constituted by a reserve bowl and an electric pump having its intake in the bowl. The electric pump is generally carried by the reserve bowl or by means connected thereto. Nevertheless, it is desirable to define connection means between the reserve bowl and the pump that are flexible and resilient, firstly to allow a certain amount of relative displacement between the pump and the bowl, in particular when the pump switches on and off, and secondly to avoid transmitting vibration from the pump to the reserve bowl and thence to the tank itself.

Numerous pump suspension devices have already been proposed for this purpose.

By way of example, reference can be made to the following documents: DE 27 50 081 (which discloses a suspension assembly comprising an open ring having internal studs); U.S. Pat. No. 4,964,787 (which discloses a suspension assembly comprising a cylindrical cage having axial tongues); EP 0 230 526 (which discloses a pump suspension assembly comprising an outer ring, an inner ring which carries the pump, and a plurality of arms interconnecting the two rings); EP 0 728 937 (which discloses a structure very similar to EP 0 230 526); DE 43 36 574 (which discloses a structure very similar to EP 0 728 937 and EP 0 230 526); DE 37 04 191; U.S. Pat. No. 4,780,063; FR 2 394 472; EP 0 131 835; U.S. Pat. No. 3,418,991; DE 37 14 307 (which discloses a suspension assembly comprising an open cage provided with rigid internal arms); DE 35 14 594; U.S. Pat. No. 4,309,155; GB 2 054 755; DE 27 35 917; and FR 2 740 835.

OBJECTS AND SUMMARY OF THE INVENTION

An object of the present invention is to propose a device presenting properties that are better than those of previously known devices.

The above object is achieved in the context of the present invention by a device for suspending an electric pump in a fuel-drawing assembly in a motor vehicle, the device comprising: an outer support suitable for surrounding the electric pump, centered on an axis parallel to the axis of the electric pump, and adapted to be secured to the fuel-drawing assembly; and at least one resilient arm connected to the inside periphery of said outer support, which resilient arm extends essentially in a plane that is transverse to the axis of said outer support and possesses a shape such as to rest at least substantially tangentially against the body of the electric pump over a fraction of its length in order to support it at a distance from the outer support.

According to an advantageous characteristic of the invention, the outer support is formed by a ring that may be open or closed.

The present invention also provides fuel-drawing devices fitted with such a pump suspension device.

BRIEF DESCRIPTION OF THE DRAWINGS

Other characteristics, objects, and advantages of the present invention appear on reading the following detailed description with reference to the accompanying drawings, given as non-limiting examples, and in which.

MORE DETAILED DESCRIPTION

Figure 1:
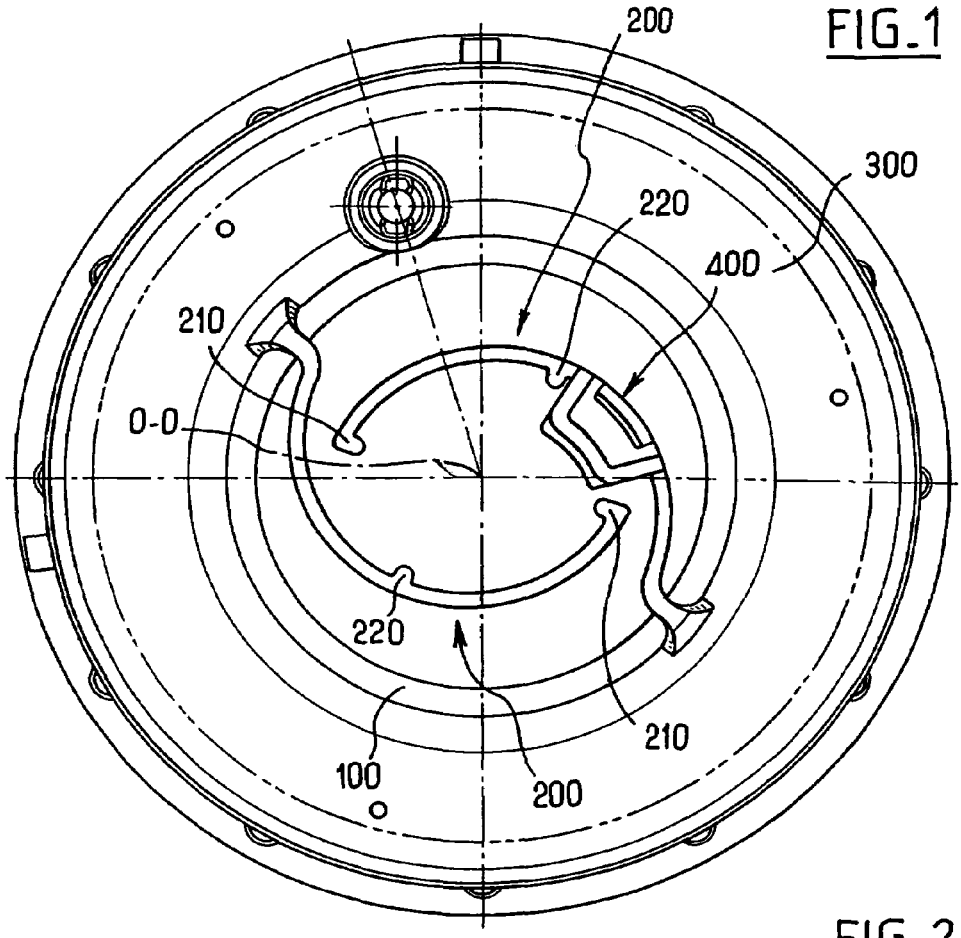
FIG. 1 is a plan view of a device constituting a preferred embodiment of the present invention.
Figure 2:
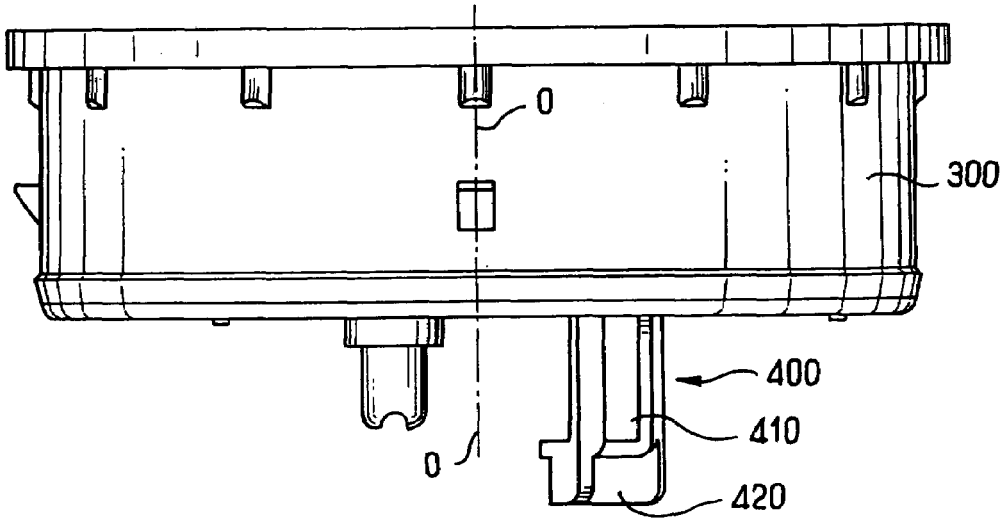
FIG. 2 is a side view of the same device.

The preferred embodiment shown in accompanying FIGS. 1 and 2 is described initially.

As specified above, the pump suspension device in accordance with the present invention comprises an outer support ring 100 and at least one resilient arm 200.

In a particular and non-limiting embodiment shown in accompanying FIG. 1, the suspension device has two arms 200 that are symmetrical about the axis O-O of the ring 100.

The ring 100 and the arms 200 are preferably constituted by a single piece, most preferably by molding a piece of plastics material.

The plastics material is advantageously polyoxymethylene (POM).

By way of non-limiting example, the ring 100 has an outside diameter of about 65 millimeters (mm), a thickness of about 2.2 mm, and height measured parallel to the axis O-O of about 29 mm.

The ring 100 is designed to be secured to the fuel-drawing assembly.

In this respect, the ring 100 can be fitted to the fuel-drawing assembly, for example onto a reserve bowl or a lid for the bowl, and it can be fixed thereto by any appropriate means, for example by adhesive, heat-sealing, clip-fastening, or an equivalent.

In a variant, as shown in accompanying FIGS. 1 and 2, the support ring 100 may be formed integrally on an element of said fuel-drawing assembly, for example a reserve bowl or a bowl lid.

Still more precisely, in the particular and non-limiting embodiment shown in accompanying FIGS. 1 and 2, the ring 100 constitutes the radially inner wall of a generally ring-shaped cage 300 for receiving an annular filter associated with the pump.

In the particular and non-limiting embodiment shown in accompanying FIGS. 1 and 2, the suspension device comprises two curved arms 200 with their concave sides facing towards the axis O-O. Each of the two arms 200 carries two studs 210, 220 projecting from its concave surface, pointing generally radially towards the axis O-O.

More precisely, each arm 200 has one stud 210 in the vicinity of its free end, i.e. its end remote from its zone where it connects with the ring 100, and a second stud 220 substantially halfway along.

Each arm 200 is generally in the form of a circularly cylindrical wall.

Still more precisely, each arm 200 is adapted to exert identical stress on the body of the pump via each of the studs 210 and 220, regardless of the extent to which the arm 200 is deformed. In other words, the two arms 200 and the four associated studs 210, 220 are designed to define four springs or resilient members that are practically identical and that engage the pump body in order to hold it.

The mechanical characteristics of the arms 200 associated with the studs 210, 220 are adapted to define mechanical properties that lie outside any resonant frequency of the fuel-drawing assembly.

Still more precisely, as can be seen in FIG. 1, each of the two arms 200 preferably presents a mean radius (i.e. distance to a geometrical axis coinciding with the axis of the pump) which decreases going towards the free end of the arm 200.

In practice, each arm 200 may comprise two cylindrical portions: a first portion going from its zone where it connects with the ring 100 to the stud 220, and a second portion extending between the two studs 220 and 210, the two portions each having the same radius, but being centered on different centers.

The suspension device shown in the accompanying figures is preferably adapted to support the electric pump in the vicinity of its center of gravity.

Typically, the arms 200 are of thickness of about 1.9 mm, of mean radius of about 20 mm, and of height measured parallel to the axis O-O that is substantially identical to the height of the ring 100.

As can be seen in FIG. 2, one of the arms 200 is preferably extended axially downwards so as to define means 400 suitable for supporting the body of the electric pump axially.

Still more precisely, these means 400 preferably comprise a column 410 substantially parallel to the axis O-O and provided at its bottom end with a hook or projection 420 extending radially inwards and designed to support the bottom wall of the body of the electric pump.

This element 420 may itself be provided with a finger projecting axially upwards so as to prevent the body of the electric pump from turning by engaging in a complementary shape provided in said body.

Figure 3:
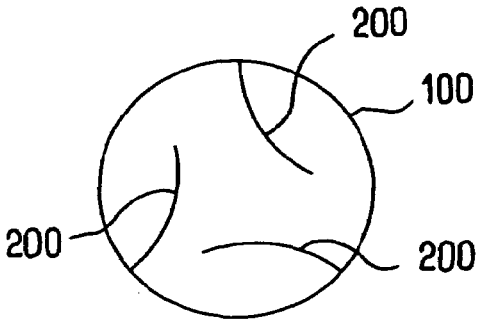
FIGS. 3 to 6 show four variant embodiments in accordance with the present invention.

FIG. 3 shows a variant embodiment in which the resilient arms are constituted by a series of fins 200 (e.g. three fins 200 as shown in non-limiting manner in this embodiment), which fins are uniformly distributed around the axis O-O, being secured to the radially inner surface of the ring 100 and being convex towards the axis O-O. The fins 200 at rest define a central space that is smaller than the size of the body of the electric pump so as to support it resiliently.

Figure 4:
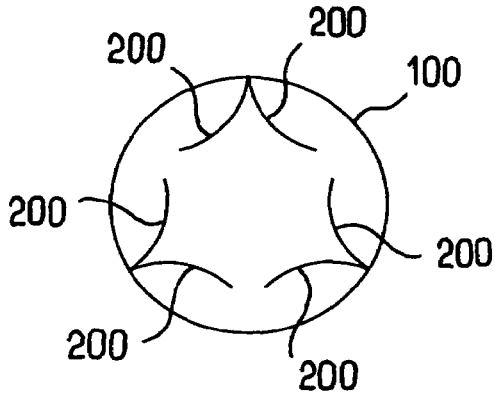

FIG. 4 shows a variant embodiment in which the resilient arms are formed in pairs of fins 200 (three pairs in the non-limiting embodiment shown in FIG. 4), the fins 200 forming flared V-shapes uniformly distributed around the axis O-O and each being generally convex towards the axis O-O.

Figure 5:
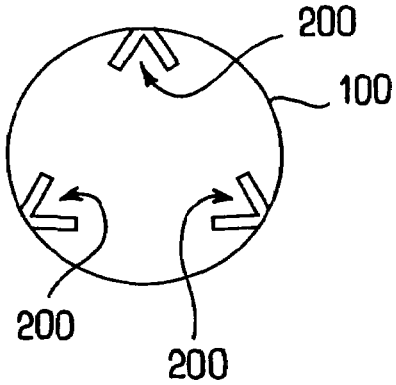

FIG. 5 shows a variant embodiment in which the resilient arms are formed by pairs of substantially rigid fingers 200 (three pairs in the non-limiting embodiment shown in FIG. 5). Each pair of rigid fingers 200 shown in FIG. 5 is generally in the form of a V-shape with the open part of the V-shape facing towards the axis O-O.

Figure 6:
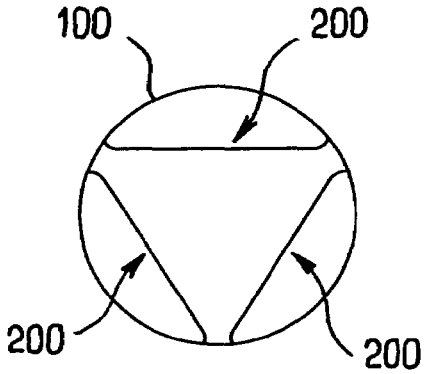

Finally, FIG. 6 shows a variant embodiment in which the resilient arms are formed by beams 200 connected at each end to the inside surface of the support ring 100. Thus, at rest, each arm 200 shown in FIG. 6 lies substantially along a chord of the ring 200. Nevertheless, as can be seen on examining FIG. 6, and preferably, the ends of the beams 200 are connected to the inside surface of the ring 100 in a direction that is generally orthogonal to the surface thereof.

Naturally, the present invention is not limited to the particular embodiments described above but extends to any variant within its spirit.

What is claimed is:

1. A suspension device for an electric pump of an assembly for drawing fuel in a motor vehicle, the device comprising: an outer support suitable for surrounding the electric pump, centered on an axis parallel to the axis of the electric pump, and adapted to be secured to the fuel-drawing assembly; and at least two resilient arms connected to the inside periphery of said outer support, which resilient arms extend essentially in a plane that is transverse to the axis of said outer support and possess a concave shape facing the axis of the electric pump, wherein each resilient arm is in the form of a circular wall which extends between a first end linked by molding to the inside periphery of said outer support and a second free end which can be deformed and which is provided with a stud which rests on the outside periphery of said electric pump, without penetrating said outside periphery of said electric pump so as to allow a relative rotation between said stud and said electric pump.

2. A device according to claim 1, wherein the outer support is formed by a closed ring.

3. A device according to claim 1, wherein the outer support is formed by an open ring.

4. A device according to claim 1, wherein each arm carries a plurality of studs adapted to apply identical stresses to a central electric pump body.

5. A device according to claim 1, wherein the mean radius of each arm relative to a center coinciding with the axis of the pump decreases going towards the free end of the arm.

6. A device according to claim 1, wherein the resilient arms are symmetrical about the axis O-O of the ring.

7. A device according to claim 1, wherein the ring and the resilient arms are made by a single molding of plastics material.

8. A device according to claim 1, the device being made of polyoxymethylene.

9. A device according to claim 1, the device being designed to be supported on a fuel-drawing assembly.

10. A device according to claim 1, the device being formed integrally on an element of a fuel-drawing assembly.

11. A device according to claim 1, wherein one arm carries means adapted to act as an axial support for the electric pump.

12. A device according to claim 1, having means suitable for constituting an angular abutment for the electric pump body.

13. An assembly for drawing fuel in a motor vehicle, the assembly including an electric pump suspension device according to claim 1.

* * * * *